US007661649B2

(12) United States Patent
Baker et al.

(10) Patent No.: US 7,661,649 B2
(45) **Date of Patent: *Feb. 16, 2010**

(54) SYSTEM FOR VERTICALLY FORMING CONCRETE PANELS

(75) Inventors: William Brent Baker, Heber, UT (US); David McKay Balls, Oakley, UT (US); Daniel M. Balls, Oakley, UT (US); Clyde D. Allen, Highland, UT (US)

(73) Assignee: Verti-Crete, LLC, Sandy, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/699,767

(22) Filed: Jan. 29, 2007

(65) Prior Publication Data

US 2007/0215785 A1 Sep. 20, 2007

Related U.S. Application Data

(63) Continuation-in-part of application No. 10/676,670, filed on Sep. 30, 2003, now Pat. No. 7,182,307.

(51) Int. Cl.
*B28B 7/24* (2006.01)
*B22D 19/02* (2006.01)

(52) U.S. Cl. ..... 249/120; 249/93; 249/160; 249/163; 29/428

(58) Field of Classification Search ..... 249/30, 249/91, 93, 96, 97, 119, 120, 123, 126, 160, 249/163, 190, 191, 216; 152/527, 539, 540; 29/525.01, 428

See application file for complete search history.

(56) References Cited

U.S. PATENT DOCUMENTS

| | | | | |
|---|---|---|---|---|
| 1,194,862 A | | 8/1916 | Moore | |
| 1,607,114 A | * | 11/1926 | Byrd | 249/15 |
| 1,760,282 A | | 5/1930 | Pedersen | |
| 2,659,123 A | | 11/1953 | georgii et al. | |
| 2,705,851 A | | 4/1955 | Duerr | |

(Continued)

FOREIGN PATENT DOCUMENTS

JP 02045108 A * 2/1990

(Continued)

*Primary Examiner*—Philip C Tucker
*Assistant Examiner*—Dimple N Bodawala
(74) *Attorney, Agent, or Firm*—Thorpe North & Western LLP

(57) ABSTRACT

A concrete mold device for vertically forming a concrete panel comprises a plurality of concrete forms for collectively defining a mold cavity for receiving an uncured concrete mixture therein. The concrete forms include: a pair of opposing side wall forms configured to define side wall surfaces of the mold cavity; and a pair of opposing end wall forms, configured to define end wall surfaces of the mold cavity. An elongate lower support gasket has an upper surface configured to define a bottom surface of the mold cavity, the lower support gasket having gasket side walls configured to abut against at least a portion of each of the side wall forms to provide a seal between the lower support gasket and the side wall forms to retain the concrete mixture within the mold cavity. Reinforcing structure is associated with the lower support gasket to increase a load-bearing capacity of the lower support gasket.

11 Claims, 6 Drawing Sheets

U.S. PATENT DOCUMENTS

| | | | | |
|---|---|---|---|---|
| 3,010,174 | A | 11/1961 | McCall | |
| 3,471,910 | A | 10/1969 | Slavin | |
| 3,511,467 | A | 5/1970 | Rohrer | |
| 3,743,235 | A | 7/1973 | Shelley | |
| 3,804,361 | A * | 4/1974 | Camus | 249/78 |
| 4,266,922 | A * | 5/1981 | Birjukov et al. | 425/182 |
| 4,545,416 | A | 10/1985 | Itoh et al. | |
| 4,609,499 | A | 9/1986 | Esashi et al. | |
| 4,614,325 | A * | 9/1986 | Muldery et al. | 249/120 |
| 5,284,326 | A | 2/1994 | Chiovitti et al. | |
| 5,556,488 | A | 9/1996 | Gergele et al. | |
| 5,871,787 | A * | 2/1999 | Fitzgerald et al. | 425/552 |
| 6,403,696 | B1 | 6/2002 | Barber et al. | |
| 7,182,307 | B2 * | 2/2007 | Baker et al. | 249/120 |
| 2006/0137273 | A1 * | 6/2006 | Baker et al. | 52/426 |

FOREIGN PATENT DOCUMENTS

| | | |
|---|---|---|
| WO | WO 9737834 A1 * | 10/1997 |

* cited by examiner

SYSTEM FOR VERTICALLY FORMING CONCRETE PANELS

PRIORITY DATA

This application is a continuation-in-part of U.S. application Ser. No. 10/676,670, filed on Sep. 30, 2003, now U.S. Pat. No. 7,182,307, which is incorporated herein by reference.

BACKGROUND OF THE INVENTION

1. Field of the Invention

The present invention relates generally to a system for vertically forming concrete panels for use in erecting concrete fences, walls and related structure.

2. Related Art

Vertically oriented concrete panels have been used for a number of years in applications including concrete fences, sound walls, partitions, etc. Concrete panels are often poured and cured in a central manufacturing area and shipped as cured panels to job sites, where the panels can be assembled into a fence or similar structure. It is often desirable to apply a textured, decorative finish to such concrete panels to enhance the appearance of the panels. Decorative finishes such as pseudo-brick finishes, pseudo-rock wall finishes, etc., give the concrete panels a more aesthetically pleasing appearance, and in some cases, such as in sound wall applications, can increase the effectiveness of the concrete panels.

Due to the difficulties inherent in vertically forming panels from uncured concrete, conventional processes often utilize a horizontal mold system to form panels which will be used in a vertical orientation. In one such method, a horizontal mold is formed that is relatively long and wide in relation to its vertical thickness; for instance 12 feet in length by 6 feet in width by 4 inches in vertical thickness. Such a horizontal mold would produce a vertical panel approximately 12 feet in length, 6 feet in height and 4 inches in horizontal thickness. While this process can provide a vertical panel having the desired vertical dimensions, it generally consumes a considerable amount of human labor and space. For instance, simultaneously pouring a sufficient number of concrete panels to erect 120 linear feet of fence would require at least 720 square feet of floor space to erect the molds, and additional floor space for movement of workers, equipment, etc.

In addition to the excessive labor hours and space such a process requires, applying a decorative finish on both sides of the horizontally-poured panel has proved difficult. For example, it is relatively easy to apply a decorative imprint on a bottom surface of a horizontal mold by placing an inverted, patterned mold form on the bottom of the mold which then forms the decorative imprint on lower side of the concrete panel. As the wet concrete is poured into the mold, the weight of the wet concrete ensures that the concrete fills indentations in the patterned mold to accurately form the pattern in the finished panel. However, such a process will only result in one side of the panel having a decorative imprint. While it may be possible to "press" an upper patterned form onto a horizontal mold in an attempt to apply a decorative finish on the opposing side of the panel, such a process can lead to voids or other irregularities appearing in the opposing side, as the weight of the concrete does not act to ensure that the concrete fills indentations corresponding to the decorative pattern desired.

For at least these reasons, attempts have been made to vertically pour concrete panels. This can be done by erecting forms which roughly correspond to the orientation the concrete panel will assume in use. However, conventional attempts to vertically pour panels have suffered from a number of problems. For example, vertically oriented forms are often held together by metal ties that are disposed through each wall form and the mold cavity that restrain the wall forms from separating in response to the weight of the uncured concrete poured into the cavity. This is problematic in that the resulting panel is structurally and aesthetically compromised by either the presence of the tie within the cured panel or a void left in the cured panel by removal of the tie.

In addition, vertically forming concrete panels has proved problematic in that the wet concrete poured into the forms has the tendency to flow under the forms and out of the mold cavity defined by the forms. This is especially problematic near the bottom of the forms, as it is at this location that the pressure from the weight of the uncured concrete is the greatest. Thus conventional methods of forming vertical concrete panels have produced panels that are structurally or aesthetically wanting, and often result in wasted materials and excessive labor due to leakage of uncured concrete from the mold.

SUMMARY OF THE INVENTION

It has been recognized that it would be advantageous to develop a system for vertically forming concrete panels that can effectively retain uncured concrete in vertical forms. It has also been recognized that it would be advantageous to develop a system for vertically forming concrete panels that produces concrete panels with no discontinuities within the panel and with an aesthetically pleasing decorative pattern formed on both sides of the panel.

The invention provides a concrete mold device for vertically forming a concrete panel, including a plurality of concrete forms for collectively defining a mold cavity for receiving an uncured concrete mixture therein. The concrete forms can include: a pair of opposing side wall forms configured to define side wall surfaces of the mold cavity; and a pair of opposing end wall forms, configured to define end wall surfaces of the mold cavity. An elongate lower support gasket can have an upper surface configured to define a bottom surface of the mold cavity, and the lower support gasket can have gasket side walls configured to abut against at least a portion of each of the side wall forms to provide a seal between the lower support gasket and the side wall forms to retain the concrete mixture within the mold cavity. Reinforcing structure can be associated with the lower support gasket to increase a load-bearing capacity of the lower support gasket.

In accordance with another aspect of the invention, a concrete mold device for vertically forming a concrete panel is provided, including a plurality of concrete forms for collectively defining a mold cavity for receiving an uncured concrete mixture therein. The concrete forms can include: a pair of opposing side wall forms configured to define side wall surfaces of the mold cavity; a pair of opposing end wall forms, configured to define end wall surfaces of the mold cavity; and an elongate lower support gasket having an upper surface configured to define a bottom surface of the mold cavity. The lower support gasket can have a sealing surface along gasket side walls to provide a seal between the lower support gasket and the side wall forms to retain the concrete mixture within the mold cavity. A seal enhancer adjacent the seal can enhance the seal between the lower support gasket and the side wall forms.

Additional features and advantages of the invention will be apparent from the detailed description which follows, taken in conjunction with the accompanying drawings, which together illustrate, by way of example, features of the invention.

DETAILED DESCRIPTION

Figure 1:
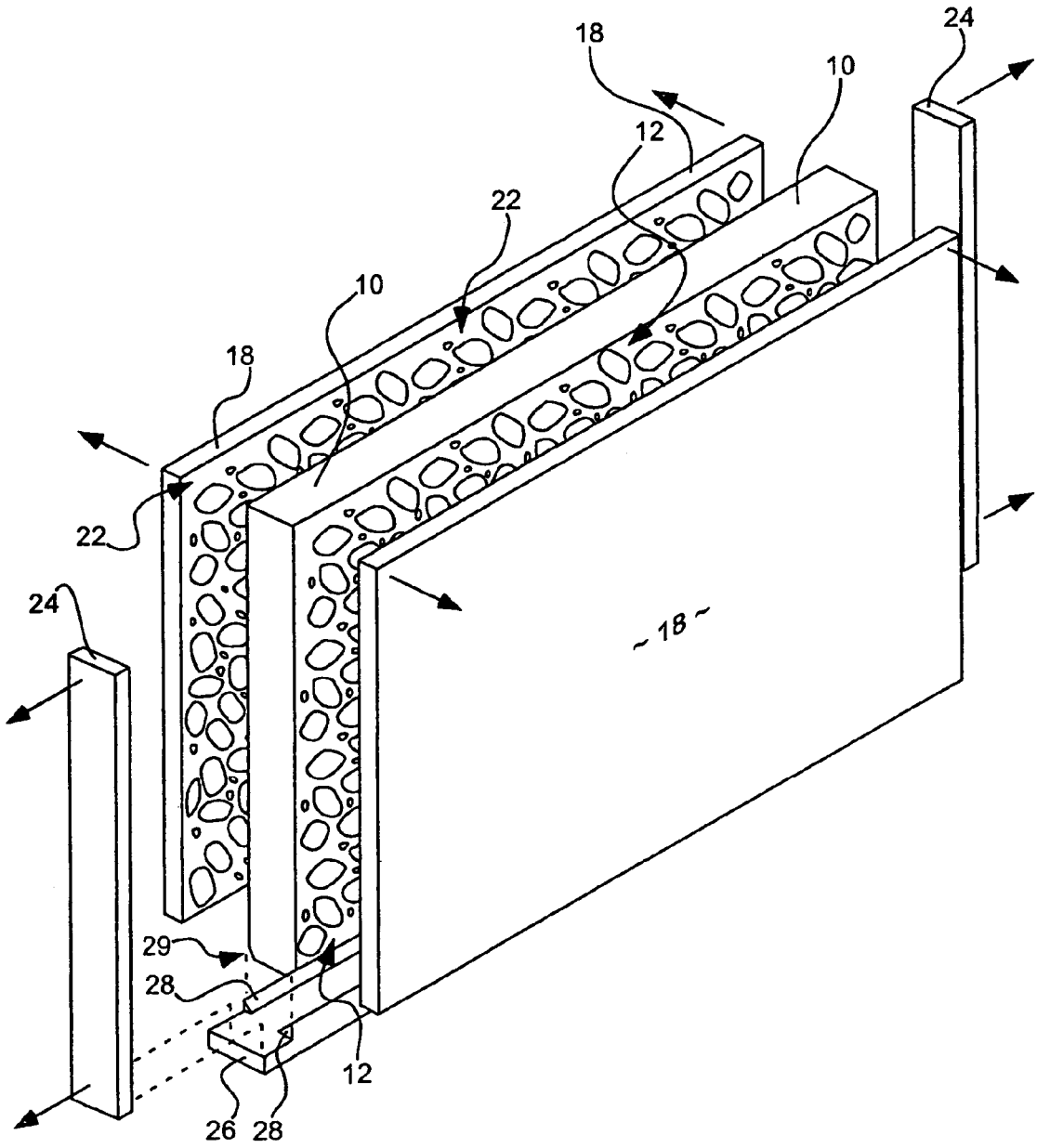
FIG. 1 is a perspective view of a vertical concrete panel formed in accordance with an embodiment of the present invention, including a system of associated concrete forms.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Illustrated in FIG. 1 is an example of a vertical concrete panel 12 formed in accordance with one aspect of the system described herein. As discussed in more detail below, various forms and structure such as side wall forms 18, end wall forms 24 and lower support gasket 26 can be utilized to form the vertical concrete panel 12. Vertical concrete panels such as that shown are used in a variety of applications, including residential and commercial fencing, sound wall applications, etc. Concrete panels formed in accordance with the present invention generally require little or no maintenance, provide superior strength, and can be relatively quickly assembled on the job site into a fence or other structure. Assembly of the panels into a fence structure is generally accomplished by installing or forming posts (not shown) which include slot structure into which the panels are disposed and held securely.

The concrete panel 10 can include a decorative pattern 12 formed in at least one side of the panel. In one embodiment of the invention, the decorative pattern is advantageously formed simultaneously in both sides of the panel. The decorative pattern can be formed to appear as a rock wall, a brick wall, or other such desirable patterns. As used herein, the term "decorative pattern" is understood to mean a pattern applied to the concrete panels, and may be decorative or functional, or both, in nature. In addition to the decorative pattern applied to the panel, the concrete panel can be stained or dyed in a particular color scheme to enhance the aesthetically pleasing appearance of the panel.

The present system can be utilized to form concrete panels of a variety of sizes. For example, vertical concrete panels can be formed with a length of 12 feet, a height of 6 or 8 feet, and a thickness of 4 inches. As described in more detail below, panels of varied width can be formed with the present system, including panels with 4, 5 or 6 inch widths. The system can be adapted to provide a number of variously sized and shaped vertical concrete panels with minimal adjustments to the system being necessary to effectuate formation of differently sized panels.

Figure 2:
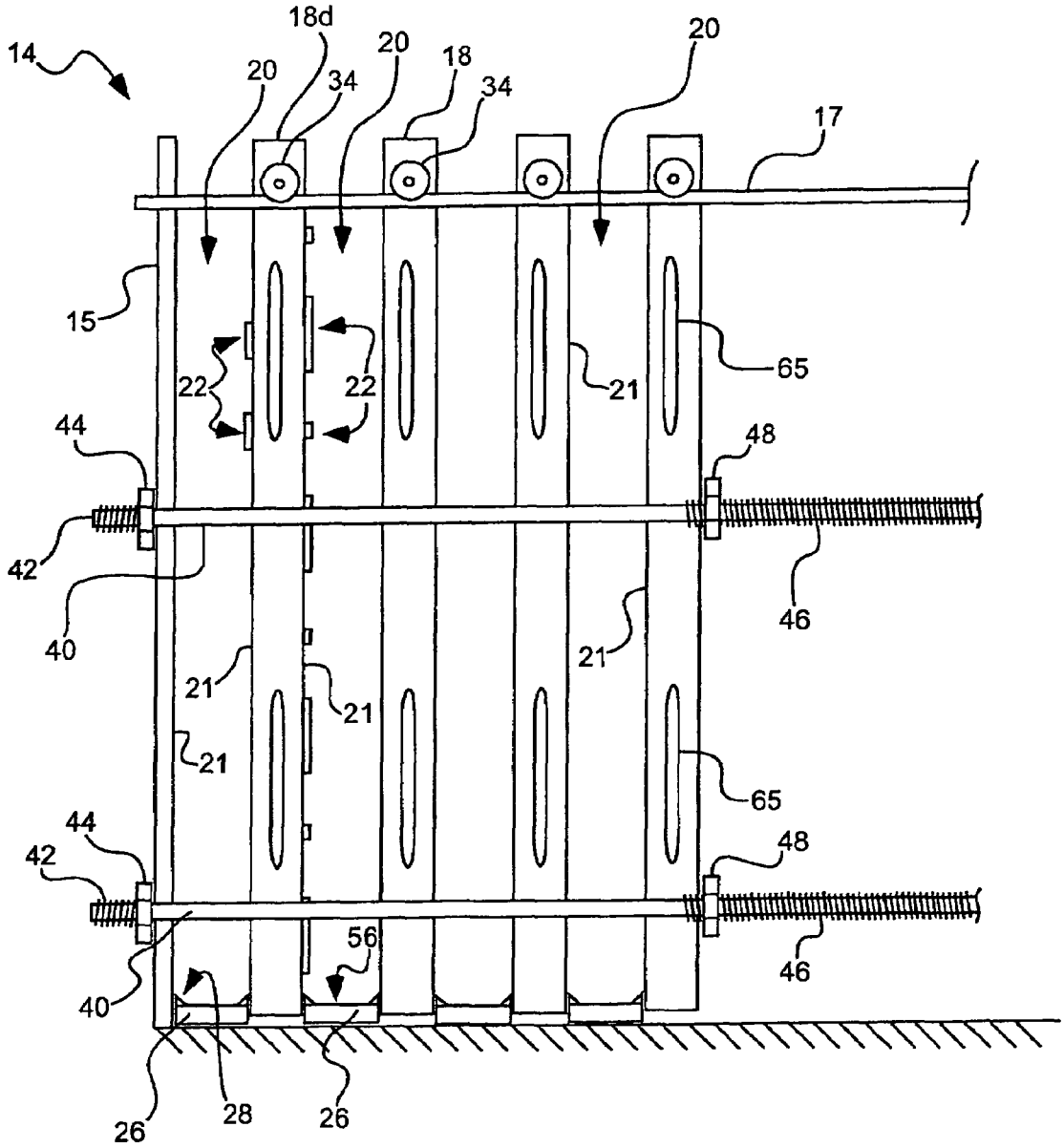
FIG. 2 is a side view of a system for vertically forming concrete panels in accordance with an embodiment of the present invention.

Shown generally at 14 in FIG. 2 is a side view of a system and device in accordance with the present invention that can be used to vertically form concrete panels such as that illustrated in at 10 in FIG. 1. The system can include a generally rectangular support frame assembly 15 (discussed in more detail below) which can receive and support a variety of concrete forms. The concrete forms can include a pair of opposing side wall forms 18 which define side wall surfaces 21 of a mold cavity 20. The side wall forms are spaced a desired distance apart, corresponding to a desired thickness of the concrete panel to be formed. End wall forms (24 in FIGS. 1, 3 and 4) can be positioned adjacent the side wall forms to define end wall surfaces 25 of the mold cavity. An elongate lower support gasket 26 can define a bottom surface of the mold cavity.

Thus, in this embodiment, the side wall forms 18, end wall forms 24 (not shown in FIG. 2) and lower support gaskets 26 are positioned to define a plurality of vertical mold cavities 20 that correspond to a concrete panel to be formed in each cavity. As discussed in further detail below, various tensioning and restraining devices can be used to ensure that the mold forms are not displaced by the introduction of uncured, or "wet" concrete in the mold cavity. Once each mold cavity is defined, and any retaining structure has been applied, wet concrete can be poured into each mold cavity. Vibrators or other agitating devices can be utilized when pouring the wet concrete to minimize voids and ensure the wet concrete fills each cavity to the extent desired.

After pouring, the concrete in the forms can be allowed to cure, after which the various retaining structure and forms can be removed. The cured panels can then be removed from the support frame assembly. In one aspect, the panels are removed by lifting equipment (not shown) which lifts each panel vertically away from the support frame assembly. The process can then be repeated a number of times to create a number of concrete panels. In the case where the proper concrete mix is used, the system can form panels on a one day cycle, that is, panels can be poured in the morning and allowed to cure through the night. The following morning, the cured panels can be removed, the forms can be reassembled, and the process begun again.

While four mold cavities 20 are defined in the system of FIG. 2, the present invention can advantageously be used to vertically form any number of panels by providing fewer or more side wall 18 and end wall 24 forms and accompanying lower support gaskets 26. In this manner, the system can be tailored to specific pour requirements. For example, a specific number of panels with a particular decorative pattern can be simultaneously poured, perhaps to correspond to a specific length of fence desired.

The side wall forms 18 can include an inverse decorative pattern 22 on one or both sides of the side wall forms. As shown in FIG. 2, inverse decorative patterns 22 can be included on both sides of the side wall form **18*d* such that side wall form 18*d* defines inside side wall surfaces of two adjacent mold cavities 20**. In this manner, only one side wall form need be positioned between adjacent mold cavities. Alternatively, two side wall forms with inverse decorative patterns can be abutted back-to-back, with the inverse decorative patterns exposed on opposing sides of the back-to-back side wall forms. Also, each side wall form can include inverse decorative patterns that differ from adjacent side wall forms, or can include no inverse pattern, in the case that a "plain" concrete panel is to be formed.

The system can be used to simultaneously form a plurality of concrete panels in a manner that utilizes minimal floor space. To illustrate the space efficient manner in which concrete panels can be formed with the present invention, consider the case in which a concrete fence is to be formed from concrete panels having dimensions of 6 feet in height, 10 feet in length and 4 inches in width. Horizontally pouring a sufficient number of panels for a fence of 100 feet in length would require as much as 600 square feet of floor space for the horizontal forms alone. In contrast, concrete panels formed vertically in accordance with the present invention can require about one-tenth of that amount, with as little as only 67 square feet of floor space being required. Because the present system laterally "stacks" vertical concrete mold cavities, optimal space savings can be obtained with the further advantage of vertically forming decorative patterns on both sides of the panels.

Support frame assembly 15 can include a variety of structures sufficient to support and contain the various forms, support gaskets, etc. Support frame assembly 15 can include roller bar 17 onto which wheels 34 associated with the side wall forms 18 can be disposed to allow the side wall forms to be easily rolled one way or another. Handles 65, or similar structure, can be included on the side wall forms to facilitate easy movement of the forms by operators.

By utilizing the integral support frame assembly 15, the present system can be formed as an integral unit that can be moved from one location to another. In this manner, a series of mold forms can be created and secured, the forms can be filled with wet concrete, and the entire system can be lifted onto a truck and moved to a job site. The panels can cure in the area in which they were poured, or can cure while in transit to a job site, saving down-time otherwise necessary to ensure the panels are cured prior to shipping. Once cured, the concrete panels can be easily removed from the forms and assembled into a fence structure.

As shown by example in FIGS. 1 and 2, the side wall forms 18 can include inverse decorative patterns 22 disposed thereon. As wet concrete is poured into the mold cavity, the weight of the wet concrete ensures that the concrete fills in and around the textured surface of the inverse decorative pattern 22. After cure, the textured surface appears in the cured concrete panel as a decorative pattern (12 in FIG. 1), such as a brick wall appearance, a rock wall appearance, etc. Because the present invention advantageously forms concrete panels in a vertical orientation, the wet concrete can fill the textured surface of inverse decorative patterns on both sides of the mold cavity equally well, in contrast to horizontal mold systems which can generally only apply a well-defined pattern to a lower surface of the panel.

The inverse decorative pattern 22 can be of a variety of inverse patterns, including brick, rock, or other pseudo structure that provides the concrete panel with a decorative or functional advantage. The inverse decorative pattern can be formed on the side wall forms 18 by a number of methods. In one aspect, an inverse decorative pattern is provided on the side wall form by application of a polymer liner to the form. The polymer liner can be formed by preparing a "master" form over which an uncured viscous polymer can be poured. When the viscous polymer cures, the resulting polymer liner can be removed from the master form and bonded or otherwise attached to a steel side wall form. Once prepared, the side wall form can be used numerous times to apply the decorative pattern to a number of concrete panels poured in cavities defined by the side wall forms. By preparing many such polymer liners from the same master form, multiple panels having identical surfaces can be concurrently formed.

Figure 4:
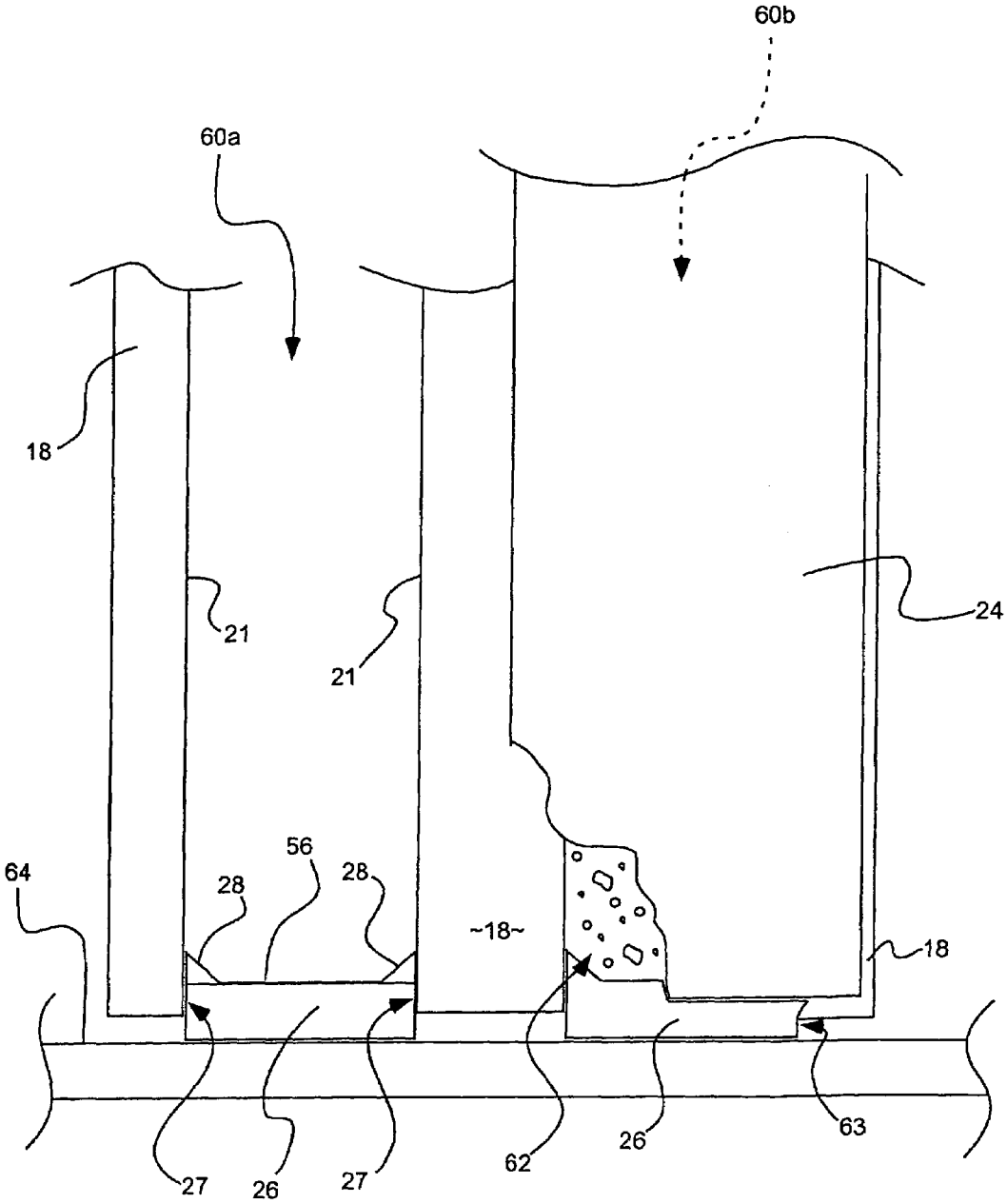
FIG. 4 is a more detailed, partially sectional side view of the system of FIG. 2.

As perhaps best seen in FIG. 4, lower support gasket 26, which defines the bottom surface of the mold cavity, can include side walls 27 which can abut against at least a portion of an inside edge 21 of each side wall form 18 to provide a seal between the lower support gasket and side wall forms to retain concrete mixture within mold cavity 60*a*, 60*b*. Also, side edge flanges 28 can extend upwardly from an upper surface 56 (best seen in FIGS. 5A through 5C) of the lower support gasket 26. The upwardly extending side edge flanges can be configured to abut against at least a portion of an inside 21 each of the side wall forms 18 to enhance the seal between the lower support gasket and the side wall forms. The side edge flanges are examples of a variety of seal enhancers utilized in the present invention that can provide reduce leakage of uncured concrete from the mold at the interface between the lower support gasket and the side walls. The lower support gasket, in combination with the side wall forms and end wall forms (end wall forms omitted from FIG. 2 for clarity), advantageously limits or prevents wet concrete from flowing outward from the mold cavity.

In past attempts to vertically pour concrete panels, problems have developed in that the wet concrete has crept outwardly from the mold cavity as the weight of the wet concrete forced the concrete under and away from the mold cavity. This has resulted in a wasteful and untidy operation, as wet concrete is not only lost but can cure outside of the forms, making the forms difficult to remove after curing. The present invention advantageously includes lower support gasket 26 having upwardly extending side edge flanges 28 which cooperatively serve the dual purpose of defining the lower surface of the mold cavity and retaining wet concrete within the mold cavity. In addition, the side edge flanges can form a chamfered edge (29 in FIG. 1) on the cured concrete panel, leading to a more attractive and less jagged top surface of the vertical panel (in this aspect, the panel is formed upside down in the mold form, with the top of the cured panel disposed at the bottom of the form).

Figure 3:
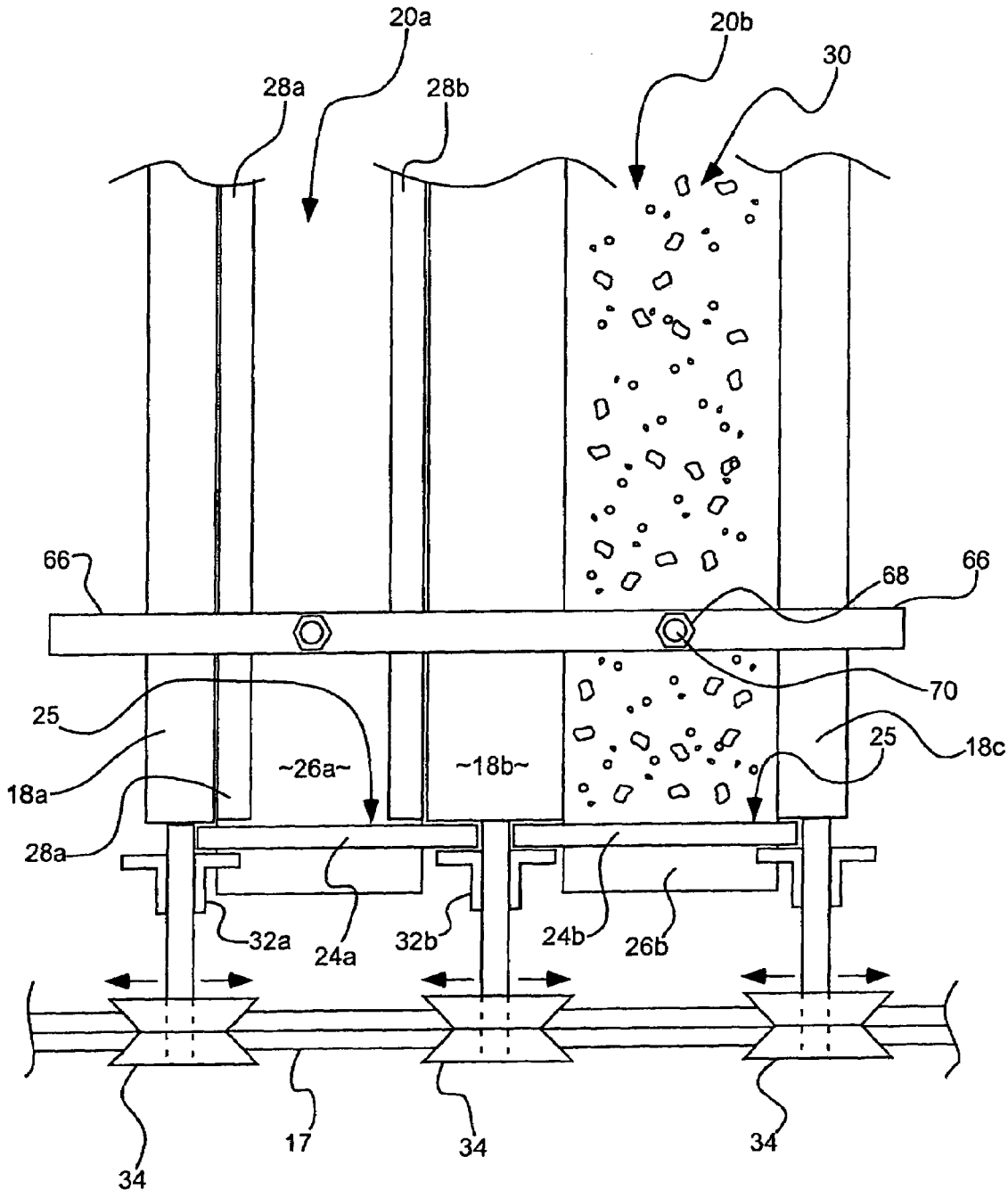
FIG. 3 is a top, partially sectional view of the system of FIG. 2.

The system 14 is shown in top view in FIG. 3, looking downward into the mold cavities 20*a* and 20*b*. In this view, the leftmost mold cavity 20*a* is shown prior to the introduction of wet concrete into the mold, and lower support gasket 26*a* having side edge flanges 28*a* and 28*b* is visible at the bottom of the mold cavity 20*a*. In contrast, rightmost cavity 20*b* is filled with concrete mixture 30, such that lower support gasket 26*b* is only partially visible. End wall form 24*a* defines the end wall surface 25 of the mold cavity 20*a*, and can be held in place by retaining structure 32 associated with side wall forms 18. In this embodiment, the side wall forms 18 are movably coupled to support frame assembly 15 by rail 17 and can include wheels or rollers 34 which allow the side wall forms to move relative to the support frame.

Thus, the mold cavities 20 can be defined by moveable concrete forms. As an example of the present invention in use, first side wall form 18*a* can be positioned in a desired location within the support frame assembly 15. Lower support gasket 26*a* can be positioned adjacent the side wall form 18*a*, with side edge flange 28*a* abutting against the side wall form 18*a*. End wall form 24*a* can then be placed within the retaining structure 32*a* associated with side wall form 18*a*. Side wall form 18*b* can then be moved into position such that end wall form 24*a* is oriented within retaining structure 32*b* associated with side wall form 18*b*. In this manner, side edge flange 28*b* is abutting against side wall form 18*b* and end wall form 24*a* is secured in place between side wall forms 18*a* and 18*b* by retaining structure 32*a* and 32*b*.

If desired, additional side wall form 18*c* can be similarly positioned with end wall form 24*b* and lower support gasket 26*b* (primarily hidden by concrete 30) forming an end and a bottom, respectively, of mold cavity 20*b*. The width of the concrete panels thus formed can be easily altered by the use of alternate end wall forms 24 and lower support gaskets 26. If a wider panel is required, wider end wall forms and support gaskets can be utilized. If a panel with a narrower width is required, narrower end wall forms and support gaskets can be used.

Once each end wall form, side wall form and lower support gasket are positioned, the forms can be restrained in position in a number of manners. Due to the substantial weight of uncured concrete, the various forms will tend to move outwardly from the defined mold cavity upon introduction of wet concrete into the cavity. As discussed above, end wall forms 24 can be secured in place by retaining structure 32. Further, as illustrated in FIG. 2, side wall tensioning members 40 can be coupled to the various side wall forms to restrain the side wall forms from moving in reaction to forces introduced by wet concrete poured in the mold cavity.

The tensioning members 40 can be a variety of those known in the art, and can include threaded end 42 which can be secured in place by nut 44. An opposing threaded end 46 can similarly be secured by nut 48. Each of the nuts 44, 48 can be tightened to tension the side wall forms together. To provide for variation in the number of mold cavities formed, threaded end 46 can include a length of threads that allow nut 48 to be attached in a variety of positions to facilitate tensioning of a varying number of concrete forms.

As shown in FIG. 2, the tensioning members 40 can be disposed outside of the mold cavity so as to retain the side wall forms in position without displacing the wet concrete in the mold cavity. In this manner, the forms are securely held in position without adversely affecting the finished panel by introducing foreign matter into the wet concrete and without leaving cavities in the concrete, as has been done in previous methods. In this manner, the concrete forms are maintained securely in place prior to curing of the concrete without compromising either the structural integrity or aesthetic appearance of the finished concrete panel.

FIG. 3 illustrates an aspect of the invention in which cured concrete panels can be easily removed from the system upon reaching sufficient cure. In this embodiment, threaded reinforcing member 70, which can be formed from or attached to material commonly known as "rebar," can be suspended within the mold cavity. An elongate strap or bar 66 can be placed over the rebar of each cavity and secured with nut 68. Wet concrete can be poured over and around the strap to fill the mold cavity. Once the panels have cured, nuts 68 and strap 66 can be removed, and the side wall forms can be rolled away from the cured panel. Reinforcing member 70, which has now been cured within the panel, can be grasped with lifting equipment and the panel can be vertically removed from the support frame assembly (not shown in FIG. 3). Thus, the strap 66 is generally the last structure applied to the system prior to pour and the first structure removed from the system after panel cure.

The lower support gasket 26 can be formed of a variety of materials, and in one embodiment is formed of a substantially compliant polymer, such as 2070 SX polymer. One advantage of this feature is illustrated in FIG. 4, wherein the leftmost mold cavity 60*a* is empty (and with which no end wall form is shown) and the rightmost mold cavity 60*b* contains uncured concrete 62. As the uncured concrete fills mold cavity 60*b*, the frictional forces between the concrete and the end wall form 24 cooperate to pull the end wall form snugly against the lower support gasket. As shown at 63, the polymer material of the support gasket can at least partially compress beneath the weight of the end wall form to provide a more secure seal between the end wall form and the support gasket.

Also shown in FIG. 4 is a lower support platform 64 over which can be disposed the various concrete forms utilized in the present system. In this aspect, the lower support gasket 26 can be slidably disposed on the lower support platform 64 to allow the support gasket to be easily and accurately associated with a set of side wall forms 18. When using a system including the sliding lower support gasket, an operator can first slidably dispose the lower support gasket 26 on the lower support platform 64. A first side wall form can then be positioned adjacent the lower support gasket, and, as the lower support gasket can slide, can move the lower support gasket into a desired position. A second side wall form can then be positioned adjacent the remaining side of the support gasket and abutted against the gasket to "sandwich" the gasket between the side wall forms. By utilizing the sliding, or floating, lower support gasket, the positions of the side wall forms are not dictated by the lower support gasket, and can be positioned in a variety of locations within the support frame assembly 15 (not shown in FIG. 4).

Figure 5A:
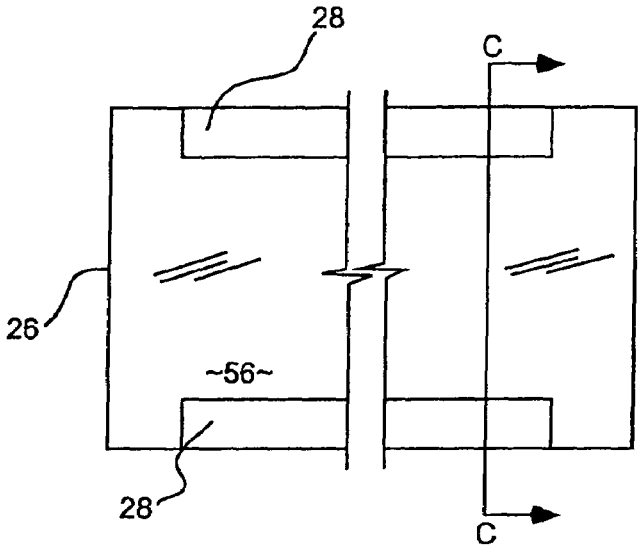
FIG. 5A is a top, sectional view of a lower support gasket in accordance with an embodiment of the invention.
Figure 5B:
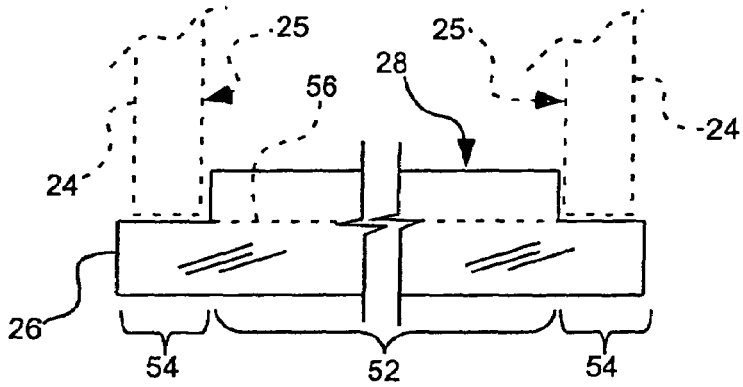
FIG. 5B is a side, sectional view of the lower support gasket of FIG. 5A.
Figure 5C:
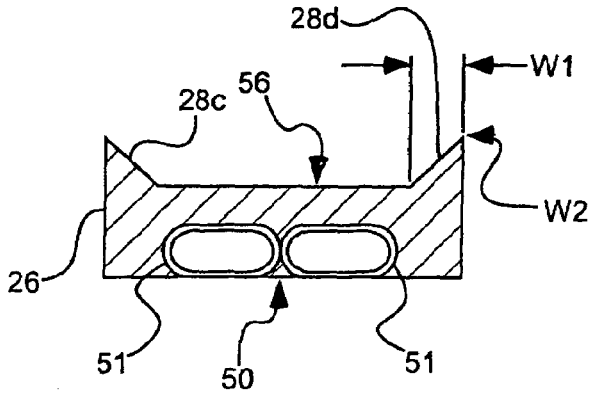
FIG. 5C is an end, sectional view of the lower support gasket of FIG. 5A.

Various features of the lower support gasket 26 are illustrated in FIGS. 5A through 5C, which correspond to side, top and end views, respectively, of the support gasket. The lower support gasket can include upper surface 56, which at least partially defines a bottom surface of the mold cavity. The lower support gasket can include a pair of side edge flanges 28 which extend upwardly from upper surface 56 of the support gasket 26 and can be configured to abut against each side wall form (not shown in FIGS. 5A through 5C). As discussed above, the support gasket can be formed of a substantially compliant polymer which can provide an effective seal between the gasket and each of the end wall forms 24 and side wall forms (not shown in FIGS. 5A through 5C). As the mold cavity in which the lower support gasket is disposed fills with wet concrete, the side edge flanges are allowed to slightly bend outwardly to form a seal that increases in effectiveness with the addition of more wet concrete. Thus, wet concrete is held within the mold cavity even when larger panels are poured, panels that may generally require greater amounts of wet concrete.

The lower support gasket can include reinforcing structure 50 which can increase a load-bearing capacity of the support gasket. The reinforcing structure can be formed from a variety of materials suitable to increase the load-bearing capacity of the support gasket, including, for example, materials which are stronger and/or stiffer than the support gasket. Examples of suitable materials from which the reinforcing structure can be formed include, without limitation, metallic materials such as steel, ceramic materials, graphite-composite materials, and the like. In general, the reinforcing structure can be formed from a material that is different than a material of which the support gasket is formed, and is generally more rigid or stiff than the surrounding support gasket material.

In one aspect of the invention, the reinforcing structure is comprised of an elongate, generally tubular steel material that extends along a majority of a length of the support gasket. The support gasket material can substantially encompass an outer portion of the reinforcing structure and/or fill a hollow interior portion of the reinforcing structure. While not so limited, in one aspect of the invention the reinforcing material can be formed from structure or material that is separate and distinct from the support gasket material. The reinforcing material can also be oriented within (or immediately adjacent to) the support gasket material in a consistent, uniform manner that is non-random in nature.

In the embodiment illustrated in FIG. 5C, the reinforcing structure is disposed at least partially within the lower support gasket to provide support to the gasket without interfering with the concrete pouring process. In this embodiment, the reinforcing structure includes a pair of substantially rectangularly-shaped steel tubes 51. The tubes can minimize the amount of compliant polymer that is needed, such that sufficient polymer is present to seal the mold cavity, but is prevented from deforming to an undesirable level by the reinforcing structure. In addition to the embodiment shown, the reinforcing structure can be disposed on, over, or adjacent to the support gasket to provide reinforcement to the support gasket.

As shown at 28*c* in cut-away view in FIG. 5C, in one aspect of the invention, side edge flange 28*c* can include a substantially triangular cross section. While it has been found that a triangular cross section provides a superior seal against the side wall forms (not shown in FIGS. 5A through 5C), other cross sections can also be utilized. In one aspect of the invention, side edge flange 28*d* can include a cross-section with a greatest width $W_1$ nearest the upper surface 56 of lower support gasket 26 and a narrowest width $W_2$ at a point furthest above the upper surface of the lower support gasket.

As shown in FIGS. 5A and 5B, in one aspect of the invention the side edge flanges 28 extend upwardly from the upper surface 56 of support gasket 26 along only a central portion 52 of a length of the support gasket, and not at terminal portions 54 of the support gasket. In this manner, the lower support gasket can provide optimal sealing contact with the side wall forms 18 (not shown in FIGS. 5A through 5C) while providing a substantially flat contact surface for the end wall forms 24. This feature can be appreciated by viewing FIG. 5B, where the side edge flanges do not extend into the terminal portions 54 of the lower support gasket which is contacted by end wall forms 24. In this manner, a superior seal is provided between the lower support gasket and the end wall forms.

Figure 6:
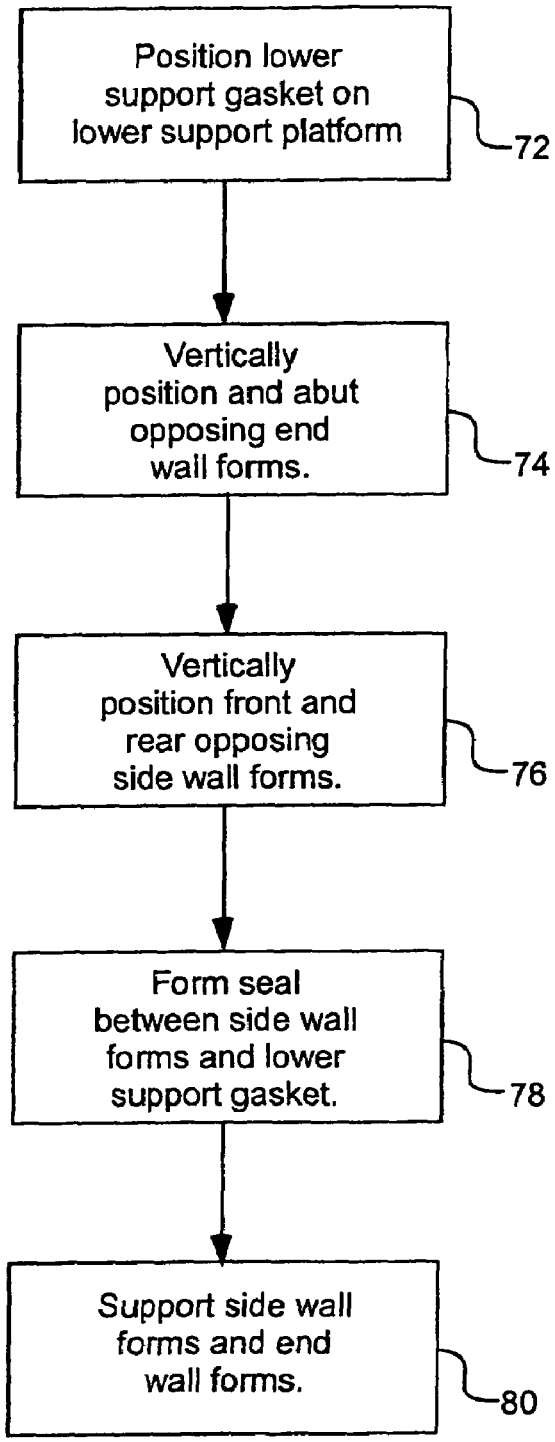
FIG. 6 is a flowchart illustrating exemplary steps of a method for vertically forming concrete panels in accordance with one aspect of the invention.

A method for utilizing the system described above is illustrated in flow chart form in FIG. 6. The method can include the steps of: positioning 72 a lower support gasket on a lower support platform, the lower support gasket having two opposing ends and two opposing sides; vertically positioning 74 and abutting two opposing end wall forms at opposing ends of the support gasket; vertically positioning 76 front and rear opposing side wall forms at opposing front and rear sides of the support gasket to thereby define a mold cavity into which an uncured concrete mixture can be poured; forming 78 a seal between the side wall forms and the lower support gasket by abutting front and rear edges of the lower support gasket against at least a portion of an interior side of the opposing side wall forms; and supporting 80 each of the side wall forms and end wall forms to resist expansion forces introduced when pouring the uncured concrete mixture into the mold cavity.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A concrete mold device for vertically forming a concrete panel, comprising:

a plurality of concrete forms for collectively defining a mold cavity for receiving an uncured concrete mixture therein, the concrete forms including:

i) a pair of opposing side wall forms configured to define side wall surfaces of the mold cavity; and ii) a pair of opposing end wall forms, configured to define end wall surfaces of the mold cavity;

an elongate lower support gasket having an upper surface configured to define a bottom surface of the mold cavity, the lower support gasket having gasket side walls configured to abut against at least a portion of each of the side wall forms to provide a seal between the lower support gasket and the side wall forms to retain the concrete mixture within the mold cavity; and reinforcing structure associated with the lower support gasket to increase a load-bearing capacity of the lower support gasket; wherein the reinforcing structure includes at least one elongate, substantially tubular member.

2. The device of claim 1, wherein the reinforcing structure is disposed at least partially within the lower support gasket.

3. The device of claim 1, wherein the reinforcing structure is formed of a different material than the lower support gasket to increase a load-bearing capacity of the lower support gasket.

4. The device of claim 3, wherein the lower support gasket is formed of a substantially compliant polymer and wherein the reinforcing structure is formed of a metallic material.

5. The device of claim 1, wherein the reinforcing structure is more rigid than the support gasket.

6. A concrete mold device for vertically forming a concrete panel, comprising:

a plurality of concrete forms for collectively defining a mold cavity for receiving an uncured concrete mixture therein, the concrete forms including:

i) a pair of opposing side wall forms configured to define side wall surfaces of the mold cavity; and ii) a pair of opposing end wall forms, configured to define end wall surfaces of the mold cavity;

an elongate lower support gasket having an upper surface configured to define a bottom surface of the mold cavity, the lower support gasket having gasket side walls configured to abut against at least a portion of each of the side wall forms to provide a seal between the lower support gasket and the side wall forms to retain the concrete mixture within the mold cavity; and reinforcing structure disposed at least partially within the lower support gasket and formed of a different material than the lower support gasket to increase a load-bearing capacity of the lower support gasket.

7. The device of claim 6, wherein the lower support gasket is formed of a substantially compliant polymer and wherein the reinforcing structure is formed of a metallic material.

8. The device of claim 6, wherein the reinforcing structure includes at least one elongate, substantially tubular member.

9. The device of claim 6, wherein the reinforcing structure is more rigid than the support gasket.

10. The device of claim 6, wherein the elongate lower support gasket further includes a pair of side edge flanges extending upwardly from an upper surface of the support gasket, each flange being configured to abut against at least a portion of a side wall form to enhance the seal between the lower support gasket and the side wall forms.

11. A concrete mold device for vertically forming a concrete panel, comprising:

a plurality of concrete forms for collectively defining a mold cavity for receiving an uncured concrete mixture therein, the concrete forms including:

i) a pair of opposing side wall forms configured to define side wall surfaces of the mold cavity; and ii) a pair of opposing end wall forms, configured to define end wall surfaces of the mold cavity; and iii) an elongate lower support gasket having an upper surface configured to define a bottom surface of the mold cavity, the lower support gasket having sealing surface along gasket side walls to provide a seal between the lower support gasket and the side wall forms to retain the concrete mixture within the mold cavity, and a seal enhancer adjacent the seal to enhance the seal between the lower support gasket and the side wall forms.

* * * * *